US010590754B2

(12) United States Patent
Tao et al.

(10) Patent No.: US 10,590,754 B2
(45) Date of Patent: Mar. 17, 2020

(54) ALONG TOOL STRING DEPLOYED SENSORS

(71) Applicant: Schlumberger Technology Corporation, Sugar Land, TX (US)

(72) Inventors: Jia Tao, Sugar Land, TX (US); Christian Spring, Houston, TX (US); Jeremy Morrison, Simonton, TX (US); Richard Lee Warns, Sugar Land, TX (US); Hikmet Andic, Elancourt (FR); Jose Escudero, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/460,312

(22) Filed: Mar. 16, 2017

(65) Prior Publication Data

US 2017/0268326 A1 Sep. 21, 2017

(51) Int. Cl.

| | |
|---|---|
| ***E21B 43/116*** | (2006.01) |
| ***E21B 47/01*** | (2012.01) |
| ***E21B 47/12*** | (2012.01) |
| ***E21B 43/119*** | (2006.01) |

(52) U.S. Cl.

CPC ..... *E21B 47/01* (2013.01); *E21B 43/119* (2013.01)

(58) Field of Classification Search

CPC ..... E21B 47/16; E21B 43/116

See application file for complete search history.

(56) References Cited

U.S. PATENT DOCUMENTS

| | | | |
|---|---|---|---|
| 8,985,200 | B2 | 3/2015 | Rodgers et al. |
| 2003/0226662 | A1 | 12/2003 | Linyaev et al. |
| 2004/0065437 | A1 | 4/2004 | Bostick, III et al. |
| 2004/0114463 | A1 | 6/2004 | Berg et al. |
| 2006/0225881 | A1 | 10/2006 | O'Shaughnessy et al. |
| 2007/0125540 | A1 | 6/2007 | Gerez et al. |
| 2007/0227727 | A1 | 10/2007 | Patel et al. |
| 2008/0079605 | A1 | 4/2008 | Jaques et al. |
| 2011/0220411 | A1 | 9/2011 | Dupont |
| 2014/0338439 | A1 | 11/2014 | Ligneul et al. |
| 2015/0167425 | A1 | 6/2015 | Hammer et al. |
| 2015/0285065 | A1 | 10/2015 | Howell et al. |

(Continued)

FOREIGN PATENT DOCUMENTS

| | | |
|---|---|---|
| CN | 2370157 | 3/2000 |
| EA | 003172 B1 | 2/2003 |

(Continued)

OTHER PUBLICATIONS

International Search Report and Written Opinion issued in the related PCT application PCT/US2016/023019, dated Dec. 15, 2016 (13 pages).

(Continued)

*Primary Examiner* — David J Bagnell
*Assistant Examiner* — Dany E Akakpo
(74) *Attorney, Agent, or Firm* — Cameron R. Sneddon

(57) ABSTRACT

A sensor system includes interconnected and axially spaced apart sensor devices deployed along an outer surface of a downhole tool string. The sensor devices including a sensor disposed with a protective housing and control electronics located remote from the sensor devices and operationally connected to the sensors.

13 Claims, 6 Drawing Sheets

(56) References Cited

U.S. PATENT DOCUMENTS

| | | | | |
|---|---|---|---|---|
| 2015/0337645 | A1 | 11/2015 | Finke et al. | |
| 2016/0130932 | A1 * | 5/2016 | Logan | E21B 17/003 166/66 |

FOREIGN PATENT DOCUMENTS

| | | | | |
|---|---|---|---|---|
| EA | 200801260 | A1 | 2/2009 | |
| GB | 2185574 | A | 7/1987 | |
| GB | 2454220 | A | 5/2009 | |
| RU | 2467160 | C2 | 11/2012 | |
| SU | 1142008 | A3 | 2/1985 | |
| WO | 2011088572 | A1 | 7/2011 | |
| WO | WO-2014084868 | A1 * | 6/2014 | G10K 11/16 |
| WO | WO-2014168960 | A2 * | 10/2014 | E21B 47/011 |

OTHER PUBLICATIONS

Combined Search and Examination Report issued in the related GB Application 1703953.8, dated Jul. 27, 2017 (8 pages).
Search and Examination Report issued in the related GB Application 1703953.8, dated May 29, 2018 (3 pages).
International Preliminary Report on Patentability issued in the related PCT application PCT/US2016/023019, dated Sep. 27, 2018 (12 pages).
Office Action issued in the related RU application 2018136583, dated May 29, 2019 (15 pages).
Search Report issued in the related GB Application 170393.8, dated May 30, 2018 (3 pages).
Examination Report issued in the related GB Application 1703953.8, dated Oct. 2, 2019 (3 pages).

* cited by examiner

ALONG TOOL STRING DEPLOYED SENSORS

CROSS-REFERENCE TO RELATED APPLICATIONS

This application claims the benefit of and priority to International Application Serial No.: PCT/US2016/023019, filed on Mar. 18, 2016 and entitled: "Along Tool String Deployed Sensors" the entirety of which is herein incorporated by reference.

BACKGROUND

This section provides background information to facilitate a better understanding of the various aspects of the disclosure. It should be understood that the statements in this section of this document are to be read in this light, and not as admissions of prior art.

Environmental conditions are monitored in wellbores utilizing various types of sensors which may be temporarily or permanently deployed. For example, in permanent installations the sensors may be located behind the casing. Sensors are also deployed in tool strings for example located in the sidewalls of collars. For use with tool strings such as perforating guns sensors have been deployed in tubular joints located between perforating gun sections.

SUMMARY

A device according to one or more aspects of the disclosure includes a clamp to attach to the outside surface of a tubular, a housing carried by the clamp and a sensor disposed with the housing. A sensor system includes sensor devices interconnected and spaced axially apart along a tool string disposed in a wellbore, each of the sensor devices including a sensor disposed with in a protective housing, and master electronics located remote from the sensor devices and operationally connected to the sensors. A downhole sensor system according to one or more aspects includes a sensor device having local sensor electronics disposed in a protective housing and disposed with a tool string in a wellbore and sensors spaced axially apart and disposed within a protective tubing and extending along the tool string, the sensors connected to the local sensor electronics and master electronics located remote from the sensor device and connected to the local sensor electronics. A method includes deploying in a wellbore sensors spaced axially apart along a perforating gun having explosive charges, communicating sensor data to master electronics located in the wellbore remote from the perforating gun and communicating the sensor date and commands between master electronics and surface located electronics.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
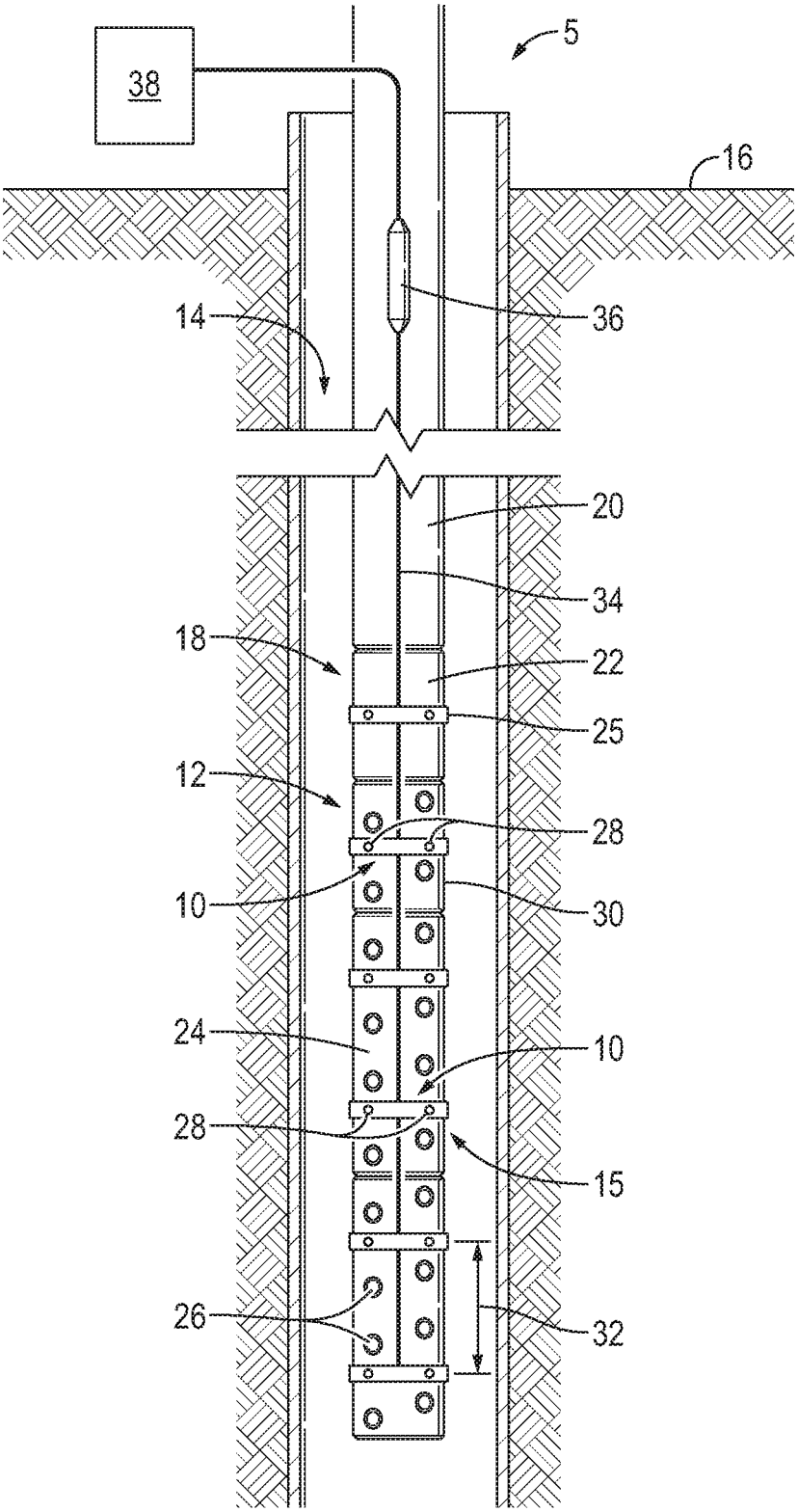
FIG. 1 illustrates sensors according to one or more aspects of the disclosure deployed in a wellbore along the outside of a downhole tool string.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

Non-limiting examples of sensor arrays 15 and sensor devices 10 that are configured to be deployed along the outside surface of a tool string 12 that is deployed downhole in a wellbore are described with reference to FIGS. 1-8. FIG. 1 illustrates a well system 5 in which sensor devices 10 are deployed along the outside surface of a tool string 12. Well system 5 includes a wellbore 14 extending into the earth from the surface 16. A bottom hole assembly (BHA) 18 including the tool string 12 is deployed in the wellbore on a conveyance 20, which is depicted in this example as a tubular, e.g., tubing, drill pipe. In this example, the tool string 12 is a perforating gun including for example a firing head 22 and multiple gun sections 24 carrying explosive charges 26. The tool string 12 is not limited to perforating guns and may include other drilling, production, and completion strings.

Each sensor device 10 includes sensor electronics 40 that are connected to one or more sensors, or sensing elements, generally denoted by the numeral 28 to measure one or more environmental properties such as and without limitation, pressure, temperature, density, flow rate, strain, and shock. The sensors 28 may be disposed with the sensor device 10 and/or deployed along the tool string and connected to the sensor device 10 for example through a control line 34. The sensor device 10 may serve as an electronics station, e.g., semi-station, for locally connected sensors 28. The individual sensor devices 10 are spaced axially along the length of the tool string and attached to the outside surface 30 of the tool string 12. The sensor devices 10 can be secured to the outer surface 30 of the tool string with an attachment mechanism 25 including without limitation clamps, straps, welding and adhesives. In accordance with one or more aspects a sensor device 10, utilized with a perforating string, may be located on a gauge carrier or intermediate gun adapter between perforating gun sections. In accordance to some aspects, the sensor devices and/or sensors may be disposed inside of the tool string.

The sensor devices 10 may be spaced at various axial distances 32 from one another as desired in the particular installation. For example, utilization of sensor devices 10 allows for positioning of sensors 28 within a small axial distance 32 from one another in a sensor array. In accordance to one or more embodiments the adjacent sensors 28 may be located within about ten feet or less of one another. In accordance to some embodiments the adjacent sensors 28 may be separated by an axial distance of about five feet or less. In accordance to some embodiments the adjacent sensors are separated axially by about one foot or less. These relatively small axial separations facilitate obtaining sensor 28 measurements that meet near-field measurement requirements and provide a sufficient spatial resolution for well monitoring and flow interpretation.

With reference to perforating guns, gauges (i.e. sensors) are known to be deployed in between the gun sections for example in inter-gun gauge carriers. While these inter-gun gauge carriers may provide protection to the sensors from the ballistic shock of the detonated perforating shots the axial spacing, for example 20 to 30 feet across gun sections, does not provide a sufficient spatial resolution for well monitoring and flow interpretation.

In the example of FIG. 1 the plurality of sensor devices 10 and sensors 28 form the sensor system or array 15. One or more of the sensor devices and sensors may be interconnected by a control line 34, e.g. serially linked, and/or by wireless telemetry such as and without limitation acoustics, induction coupling, and radio frequency communications. The depicted control lines 34 include an outer tubing 33, see e.g., FIGS. 3, 6 and 8, in which the one or more conductors are disposed. In accordance to some embodiments, the tubing 33 is about a 0.375 inch outside diameter or smaller outside diameter metal tubing. In the depicted example, the sensors 28 are electronically connected via the control line to a master electronics or control cartridge 36 that acts as a hub station that communicates with the sensors 28 and sensor electronics at the sensor devices 10. The master electronics cartridge 36 may include one or more of a power supply, e.g. a battery, processor, memory and a telemetry module (electronics). The master electronics cartridge or hub station 36 may be operated on memory mode, or with telemetry to transmit data real time, or a combination of both. The control cartridge may be utilized to locate the sensitive electronic devices a distance away from the perforating guns and remote from the sensors to mitigate the ballistic impact of the detonated explosive charges. The master electronics cartridge 36 is able to receive commands from a controller (processor) 38 located for example at the surface 16. Communications may also be achieved along the path between the sensors 28 and the surface controller 38 from one or more of wires, optical fiber, wired pipe and acoustic signals. Communication between the sensors 28 and the master electronics 36 may be bi-directional or can use a master-slave arrangement. As will be understood by those skilled in the art with benefit of this disclosure, the sensor devices 10 may communicate wirelessly with a master electronics cartridge 36 and/or a surface controller 38.

Figure 2:
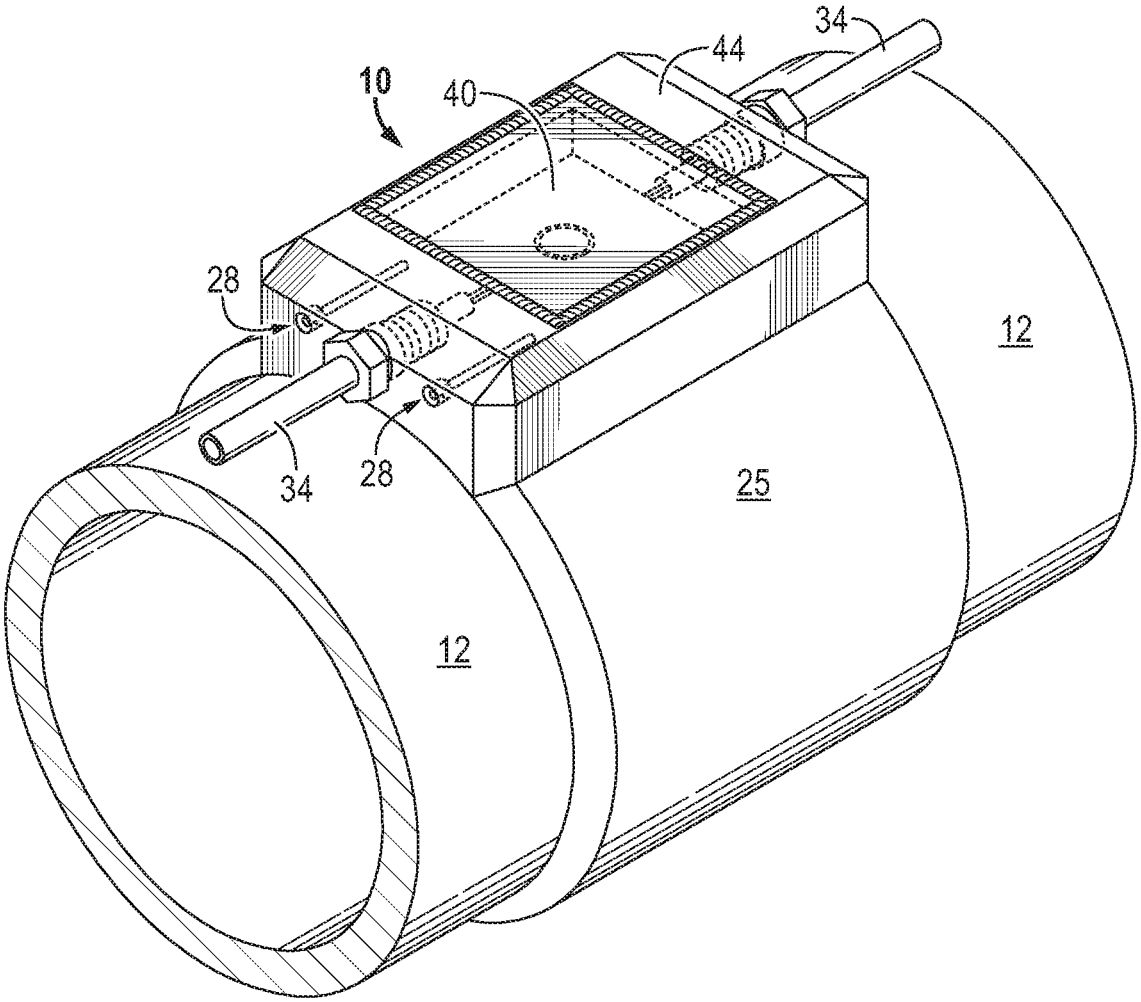
FIG. 2 illustrates an on-clamp sensor device in accordance to one or more aspects of the disclosure.
Figure 3:
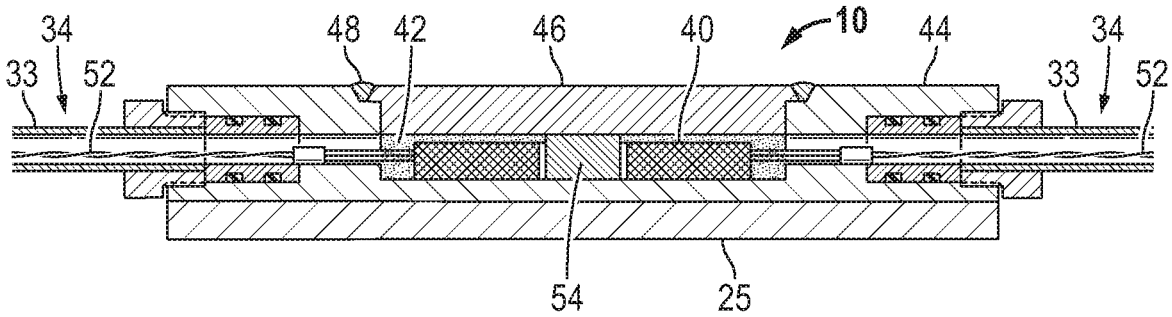
FIG. 3 is a cut-away view of an on-clamp sensor device according to one or more aspects of the disclosure.

Referring now to FIGS. 2 and 3 an example of a sensor device 10 in accordance to one or more embodiments is illustrated. The sensor device 10 includes sensor electronics 40 (e.g., circuits and interface) disposed in a cavity 42 of the sensor housing 44. The sensor housing 44 is provided by, or integral with, an attachment mechanism 25 or connected to an attachment mechanism, illustrated as a clamp to form an on-clamp sensor device. The cavity 42 may be closed with a cover 46 and secured and sealed for example by a weld 48. In FIG. 2, the sensor device 10 includes one or more sensors 28 connected to the sensor electronics 40. Sensors 28 may be located at the sensor device 10 as illustrated by the elements or probes that are in communication with the environment external to the cavity and/or the sensors 28 may be deployed along the control line 34.

Control lines 34 are illustrated extending axially away from the sensor device 10. With reference to FIG. 3, the control lines 34 include an outer protective tubing 33 which carries one or more conductors, e.g. wires, 52 that connect the local sensor electronics 40 at sensor device 10 to sensors 28 deployed in the sensor array and/or to other sensor devices 10 and/or the control electronics. The control line 34 is connected to the protective housing 44 by a connector, which is a threaded connector in FIGS. 2-4. A support 54 is shown in FIG. 3 disposed in the cavity 42 to mitigate deformation of the cover 46 due to pressure and/or shock.

Figure 4:
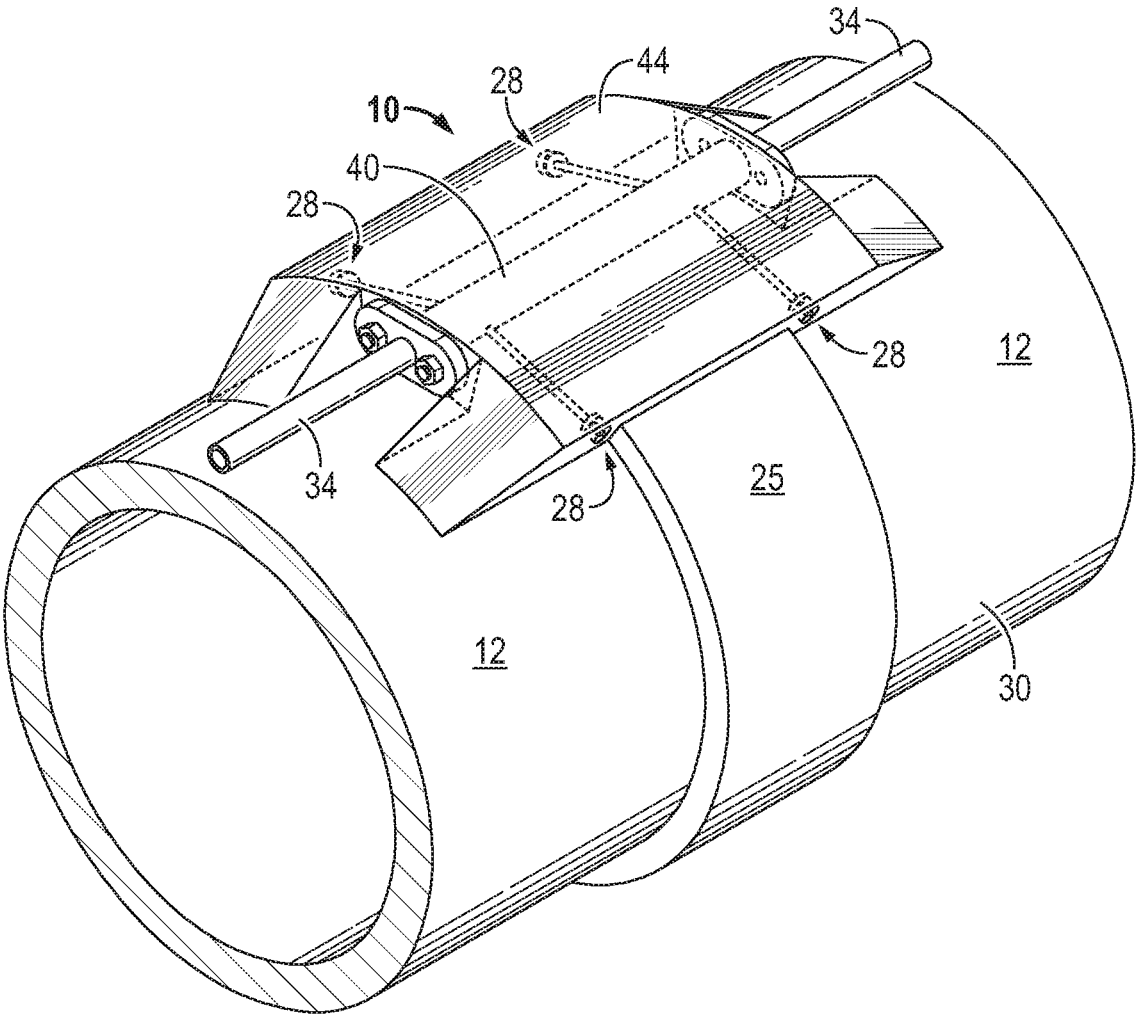
FIG. 4 illustrates an on-clamp sensor device according to one or more aspects of the disclosure.

FIG. 4 illustrates an on-clamp type of sensor device 10 attached to the outer surface 30 of a tool string 12. The sensor 28 (sensor element) is connected to the sensor electronics 40 which may be potted, e.g., to mitigate shock, in the housing 44. In this example, sensor device 10 includes one or more sensors 28, illustrated by elements or probes, which may be configured to measure one or more environmental properties. Sensors 28 may also be deployed along the control line 34 and connected to the sensor electronics of the sensor device 10 to form a sensor sub-array.

Figure 5:
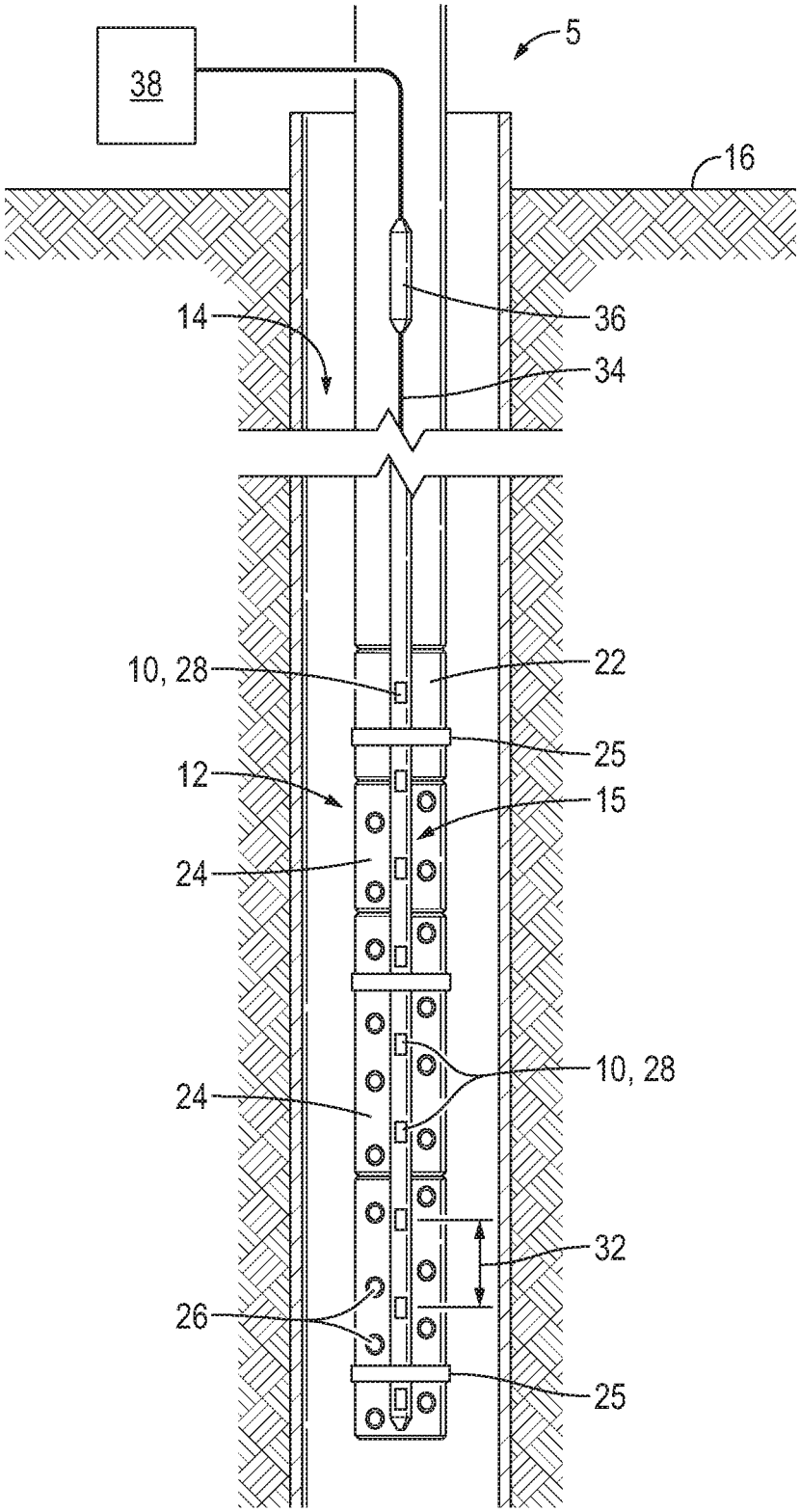
FIG. 5 illustrates a downhole sensor array according to one or more aspects of the disclosure deployed axially along a tool string that is deployed in a wellbore.

Referring now to FIG. 5, an example of a well system 5 having a sensor system or array 15 in accordance to one or more embodiments deployed along and attached to the outer surface 30 of a tool string 12 is illustrated. In the depicted well system the tool string is a perforating gun including for example a firing head 22 and one or more gun sections 24 carrying explosive charges 26. In this example the sensor array 15 includes spaced apart sensor devices 10, each having one or more connected sensors 28, deployed along and attached to the outer surface 30 of the tool string 12. The sensor device 10 may include for example sensor electronics disposed within a protective housing. The sensor device 10 may be configured in various manners such as but not limited to the device as described with reference to FIG. 6. The axially spaced sensors 28 are illustrated interconnected by a control line 34, e.g. serially linked, to form the sensor system or array 15. The sensors 28 may be self-sustained and include a sensing element and one or more of power, electronics, memory and communications devices. In accordance to aspects, self-sustained sensors may communicate wirelessly to a local sensor device and/or downhole master electronics 36 and/or to a controller or processor 38 located at the surface 16. In the depicted example, the sensors 28 are electronically connected via the control line 34 to a master electronics cartridge 36 that acts as a hub station that communicates with the sensors 28. The master electronics cartridge 36 may include one or more of a power supply, e.g. a battery, processor, memory and a telemetry module (electronics). The master electronics or hub station 36 may be operated on memory mode, or with telemetry to transmit data real time, or a combination of both. The cartridge 36 may be utilized to locate the sensitive electronic devices a distance away from the perforating guns to mitigate the ballistic impact of the detonated explosive charges. The master electronics cartridge 36 is able to receive commands from the controller 38 located for example at the surface 16.

The sensor array 15 is connected to the outer surface of the tool string 12 by attachment mechanisms 25 which are illustrated in this example as clamps. In this example the clamps are securing the control line 34, which includes an outer protective tubing, to the outside surface of the tool string. In accordance to one or more embodiments the attachment mechanisms 25 may include without limitation bonding, such as welding and adhesives. The sensor array 15 facilitates positioning the adjacent sensors 28 at small axial distances 32 from one another. For example, adjacent sensors 28 may be located within about ten feet or less of one another. In accordance to some embodiments the adjacent sensors 28 may be separated by an axial distance of about five feet or less. In accordance to some embodiments the adjacent sensors 28 are separated by about one foot. These relatively small axial separations facilitate obtaining sensor 28 measurements that meet near-field measurement requirements and provide a sufficient spatial resolution for well monitoring and flow interpretation.

Figure 6:
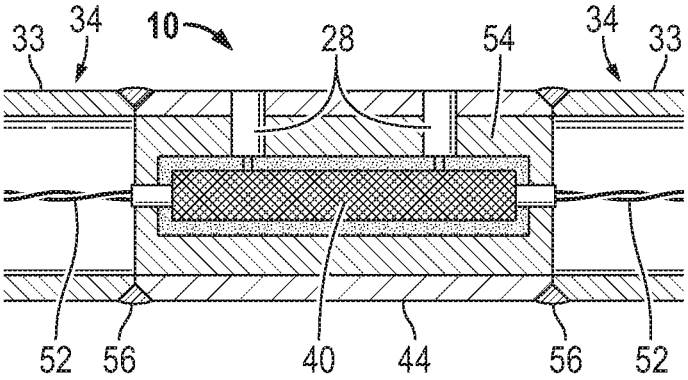
FIG. 6 illustrates an example of a sensor device according to one or more aspects of the disclosure.

FIG. 6 illustrates an example of a sensor device 10 connected within a control line 34 in accordance to one or more embodiments. Sensor device 10 includes a protective housing 44 (e.g. metal tube) carrying the local sensor electronics 40 and may also include one or more sensing elements or probes 28 (i.e., sensors). In this example, the local sensor electronics 40 are disposed in the protective housing 44 with a shock mitigating packaging 54. The protective housing 44 is connected with the control line 34, i.e., the outer tubing 33, by connectors 56, which may be for example welds or threaded connections. In this example, the conductors 52 of the control line 34 may be providing communication between adjacent sensor devices 10, between sensor devices 10, to downhole control electronics, surface control electronics, and/or extend to sub-array sensors 28 spaced apart and located along the tool string as illustrated for example in FIGS. 7 and 8.

Figure 7:
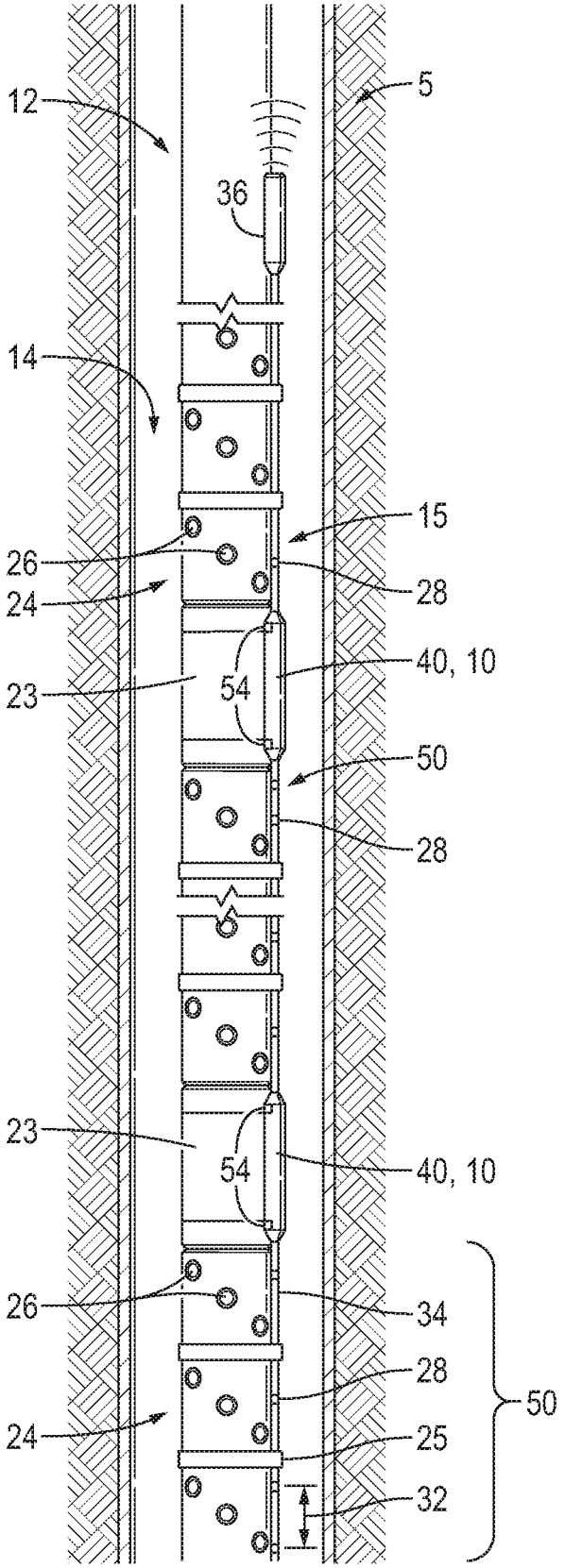
FIG. 7 illustrates a downhole sensor array according to one or more aspects of the disclosure deployed axially along a tool string that is deployed in a wellbore.

FIG. 7 illustrates a well system 5 with an along a tool string deployed sensor system or sensor array 15 according to one or more aspects of the disclosure. In this example, the tool string 12 includes perforating guns 24, or gun sections, each carrying explosive charges 26. Tubular sections 23 (e.g., subs, inter-gun gauge carriers, or gun adapters) may be positioned in between adjacent perforating guns 24 thereby axially separating tubular sections carrying the explosive charges 26. The along string sensor array 15 illustrated in FIG. 7 includes a plurality of sensors 28 that are deployed in a control line 34 in an axially spaced apart manner along the outer surface of the tool string. In particular, the sensor array system 15 is configured to space the adjacent sensors 28 at a small axial distance from one another. For example, in some aspects the axial spacing is about one foot between sensor 28 measurements which places the sensors in direct exposure to near-field pyro-shock or ballistic shock when used along perforating guns. The depicted sensor array 15 includes smaller groups or sensor sub-arrays 50. A group or sub-array 50 of sensors 28, for example resistance temperature detectors (RTD) or thermocouples, are connected through the control line 34 to a local sensor electronics 40 that may be disposed for example in a protective housing and located between gun sections 24. Examples, of local sensor electronics 40, e.g., semi-stations, include without limitation the sensor devices 10 described with reference to FIGS. 2, 4 and 6. In accordance to one or more aspects, the sensor device 10 may be embedded in the outer surface of a portion of the tool string, such as within an inter-gun sub 23. For example, as illustrated in FIG. 7 a sensor device 10 having local sensor electronics 40 disposed in a protective housing, such as a metal tubing, (see e.g., FIG. 6) may be embedded in a portion of the tool string with shock mitigating packaging 54. In accordance to some embodiments, the sensor device 10 may be connected to the tool string, e.g. along the inter-gun sub 23 by a clamp 25 which may include a shock mitigating packaging (e.g., a cushion layer with the clamp).

The local sensor electronics 40 may communicate the individual measurements of sensors 28 of its sub-array 50 of sensors to the surface via wired or wireless communications. Two or more local sensor device 10 may be connected for example via communication conductors in the control line. FIG. 7 illustrates one example of the communication of data, whereby the local sensor devices 10 communicate through wired communications to downhole master electronics 36, which may then communicate for example via acoustic telemetry to a surface controller. In accordance to one or more aspects, the sensor devices 10 may wirelessly communicate the data acquired by its connected local sensors 28 (i.e., sensor sub-array) to a surface controller and/or to a downhole controller.

Figure 8:
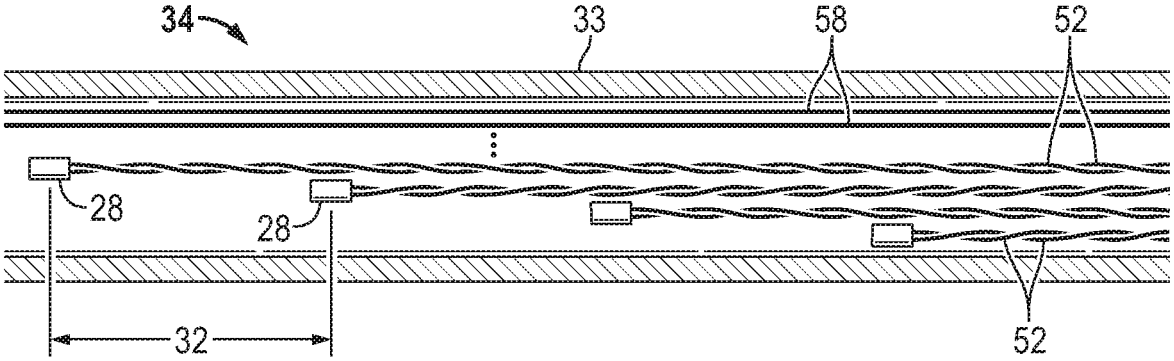
FIG. 8 illustrates sensors of an along a tool string sensor array deployed in a control line.

FIG. 8 is a sectional illustration of control line 34 deployed sensors 28. Control line 34 includes a protective tubing 33 to be disposed along the outer surface of a tool string and provide a pressure barrier to the internally disposed sensors 28. In a non-limiting example the tubing 33 is a metal tubing having an outside diameter of about 0.375 inches and capable of operating for example at 30,000 psi and 300 degrees Fahrenheit. Sensor wires 52 extend from the local sensor electronics, for example of the sensor device 10, to the sensors 28. The control line 34 may also include communication wires 58 to interconnect two or more local sensor electronics 40 (FIG. 7) together.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A sensor system, comprising:

sensor devices interconnected and spaced axially apart along the outside surface of a perforating gun string disposed in a wellbore, each of the sensor devices comprising:

a protective housing having shock mitigation packaging; and a sensor connected to sensor electronics, each of which are disposed within the protective housing; and master electronics located along the perforating gun string and remote from the sensor devices and operationally connected to the sensor devices.

2. The system of claim 1, wherein the sensor electronics are disposed in a cavity of the protective housing.

3. The system of claim 1, wherein the sensor devices are spaced axially apart about ten feet or less.

4. The system of claim 1, wherein the sensor devices are spaced axially apart about one foot or less.

5. The system of claim 1, wherein each of the sensor devices comprises a clamp connected with the protective housing to connect the sensor device to the perforating gun string.

6. The system of claim 1, wherein the sensor devices are interconnected by a control line or wireless telemetry.

7. The system of claim 1, wherein the master electronics communicate to a surface system via wireless telemetry.

8. A downhole sensor system, comprising:

a sensor device comprising local sensor electronics disposed in a protective housing, the sensor device disposed along the outside surface of a perforating gun string in a wellbore;

shock mitigation packaging within the protective housing;

sensors spaced axially apart and disposed within a protective tubing, the protective tubing extending along the outer surface of gun sections of the perforating gun string, the sensors connected to the local sensor electronics; and master electronics located along perforating gun string and remote from the sensor device and operationally connected to the local sensor electronics.

9. The system of claim 8, wherein the sensor device comprises an additional sensor disposed within the protective housing.

10. The system of claim 8, wherein the sensor device is connected to the tool string by a clamp.

11. The system of claim 8, wherein the sensors are spaced axially apart about ten feet or less.

12. A method, comprising:

housing wellbore sensors within a protective tubing having shock mitigation packaging;

deploying in a wellbore the protective tubing along an outside surface of a perforating gun string comprising a perforating pun having explosive charges, wherein the sensors within the protective tubing are spaced axially apart;

communicating sensor data to master electronics located in the wellbore along the perforating gun string and remote from the perforating gun; and communicating commands and the sensor data between the master electronics and surface located electronics.

13. The method of claim 12, wherein the sensors are connected to sensor electronics deployed along the perforating gun.

* * * * *